US007285075B2

(12) United States Patent
Cutler et al.

(10) Patent No.: US 7,285,075 B2
(45) Date of Patent: Oct. 23, 2007

(54) INCLINE TRAINER

(75) Inventors: Gordon Cutler, Providence, UT (US); Matthew R. Plott, River Heights, UT (US); William T. Dalebout, North Logan, UT (US)

(73) Assignee: Icon IP, Inc., Logan, UT (US)

( * ) Notice: Subject to any disclaimer, the term of this patent is extended or adjusted under 35 U.S.C. 154(b) by 152 days.

(21) Appl. No.: 10/733,684

(22) Filed: Dec. 11, 2003

(65) Prior Publication Data

US 2005/0130807 A1 Jun. 16, 2005

(51) Int. Cl.
*A63B 21/00* (2006.01)

(52) U.S. Cl. ..... 482/54

(58) Field of Classification Search ..... 482/54
See application file for complete search history.

(56) References Cited

U.S. PATENT DOCUMENTS

| | | | | |
|---|---|---|---|---|
| 4,759,540 | A * | 7/1988 | Yu et al. | 482/54 |
| 4,913,396 | A | 4/1990 | Dalebout et al. | 248/649 |
| 5,029,801 | A | 7/1991 | Dalebout et al. | 248/649 |
| 5,085,426 | A | 2/1992 | Wanzer et al. | 272/69 |
| 5,163,885 | A | 11/1992 | Wanzer et al. | 482/54 |
| 5,352,167 | A | 10/1994 | Ulicny | 482/54 |
| 5,372,559 | A | 12/1994 | Dalebout et al. | 482/54 |
| 5,683,332 | A | 11/1997 | Watterson et al. | 482/54 |
| 5,718,657 | A | 2/1998 | Dalebout et al. | 482/54 |
| 5,860,893 | A | 1/1999 | Watterson et al. | 482/54 |
| D421,779 | S | 3/2000 | Piaget et al. | D21/669 |
| 6,050,923 | A | 4/2000 | Yu | 482/54 |
| 6,132,340 | A | 10/2000 | Wang et al. | 482/54 |
| 6,261,209 | B1 | 7/2001 | Coody | 482/54 |
| 6,273,843 | B1 | 8/2001 | Lo | 482/54 |
| D447,780 | S | 9/2001 | Arnold et al. | D21/669 |
| D450,792 | S | 11/2001 | Kuo | D21/669 |
| 6,432,026 | B1 | 8/2002 | Wang et al. | 482/54 |
| 6,461,275 | B1 | 10/2002 | Wang et al. | 482/8 |
| 6,475,121 | B2 | 11/2002 | Wang et al. | 482/54 |
| 6,533,707 | B2 | 3/2003 | Wang et al. | 482/54 |
| 6,913,563 | B2 * | 7/2005 | Chen | 482/54 |

FOREIGN PATENT DOCUMENTS

DE WO 03/101543 A1 12/2003

OTHER PUBLICATIONS

Reebok User's Manual—ACD1 Treadmill, Copyright 1998 (26 pages).

(Continued)

*Primary Examiner*—Stephen R. Crow

(57) ABSTRACT

The present invention relates to an inclining treadmill having a hood assembly pivotally coupled between the frame and the inclining tread base of the treadmill. The configuration of the pivoting hood assembly allows the inclining tread base to incline to a grade of at least 20 percent. The pivot point of the pivoting hood assembly is positioned distally from the distal end of the tread base. The pivoting hood assembly is positioned at an angle to greater than 40 degrees when the tread base is at its greatest grade of incline. A lift motor engages a channel bracket assembly of the pivoting hood assembly at a point distal to the pivot point of the pivoting hood assembly. The inclining tread base is linked to the frame of the treadmill by being coupled to the pivoting hood assembly.

26 Claims, 8 Drawing Sheets

OTHER PUBLICATIONS

Reebok User's Manual—ACD2 Treadmill, Copyright 1998 (26 pages).
Reebok User's Manual—ACD3 Treadmill, Copyright 1998 (30 pages).
Reebok Store—Reebok RX 7200 Treadmill w/10 workout options, http://store.reebok.com/product/index.jsp, Nov. 3, 2003 (11 pages).
Treadclimber by Nautilus, Copyright 2003 (1 page).

* cited by examiner

INCLINE TRAINER

BACKGROUND OF THE INVENTION

1. The Field of the Invention

The present invention relates to exercise treadmills. In more particular, the present invention relates to exercise treadmills having a pivoting hood assembly configured to incline a tread base of the treadmill to a grade of at least 20 percent.

2. The Relevant Technology

Exercise treadmills have long been a mainstay in the home and institutional exercise industry. Exercise treadmills provide a horizontal running surface which allows a user to perform running, walking, and other exercise routines in small and confined spaces. This can be particularly beneficial in cold climates where outdoor exercising can be difficult during winter months or in metropolitan areas where outdoor running is impractical.

Some exercise treadmills utilize an inclining tread base which can provide interest and added exercise benefits over non-inclining treadmills. By including the ability to incline, such treadmills allow a user to simulate an outdoor exercise environment in which slopes, hills, inclines, or other changes in grade are encountered. Use of an incline provides a user a with a varied exercise experience while also allowing changes in intensity and targeting of different muscle groups utilized during a workout on the treadmill.

One problem encountered with the use of inclining treadmills, is that many treadmill designs only provide a small amount of incline which can limit the interest and exercise benefits associated with exercising on an inclining tread base. For example, an exercise treadmill providing a maximum of a 10 percent incline may provide little perceptible difference in incline over a traditional horizontal tread base. Furthermore, a 10 percent incline may not effectively replicate conditions encountered during an alpine hike, a strenuous hill run, or situations encountered during other outdoors activities.

Some exercise treadmills have been developed with a greater degree of incline to provide both added interest and exercise benefits not realized with other exercise treadmills. Such inclining treadmills can incline to over a 20 percent grade. While this may provide the added interest and exercise benefits not realized in other treadmills, such treadmills nevertheless suffer from several deficiencies. To achieve greater levels of incline, such treadmills utilize design configurations that add to the cost and complexity of the design of the treadmill. Additionally, such design configurations often introduce design elements that can lead to malfunctioning of components of the treadmill. For example, some designs utilize a large and heavy frame that is contiguous with much of the length of the treadmill tread base. The large and heavy frame allows the lift motors to be positioned below the tread base to efficiently raise the tread base to the desired degree of incline. However, the weight and cost associated with such heavy and large tread base frames can substantially increase the overall cost of the treadmills. Additionally, the additional weight of the treadmills can make the treadmills difficult to transport, store, and reposition in the exercise setting. The size of the frame increases the overall footprint of the treadmill. The larger footprint of the treadmill renders the benefits of a folding tread base storage position largely unbeneficial.

Other treadmill designs utilize a lift motor design which can cause twisting of the tread base frame. For example, some treadmills utilize a dual lift motor design to provide the amount of lift required to achieve the desired grade of incline of the tread base. Twisting of the tread base often results from interaction between the lift motor(s) and the tread base. The force exerted on the tread base by the lift motor(s) can be disproportionate on different parts of the tread base resulting in twisting of the tread base. Twisting of the tread base frame can result in torsion of the endless belt on the tread base. Torsion of the endless belt can cause misalignment or derailing of the endless belt.

By utilizing a lift motor design in which the lift motor does not interact directly with the tread base, twisting of the tread base can be eliminated. One exemplary design utilizes a lift motor which interacts with the hood connected at the front of the tread base. By interacting with the hood, uneven distribution of forces is minimized and reliability of the tread base and endless belt is improved. While such designs can eliminate problems associated with twisting the tread base, the grade of incline that have been realized utilizing such designs has also been limited.

BRIEF SUMMARY OF THE INVENTION

The present invention relates to an inclining treadmill having a hood assembly pivotally coupled between the frame and the inclining tread base of the treadmill. The configuration of the pivoting hood assembly allows the inclining tread base to incline to a grade of at least 20 percent. In one embodiment, the inclining tread base can incline to a grade at least 30 percent. In another embodiment, the inclining tread base can incline to a grade of at least 40 percent. In another embodiment, the inclining tread base can incline to a grade of at least 50 percent.

The pivoting hood assembly is positioned at an angle to greater than about 40 degrees when the tread base is at its greatest grade of incline. In one embodiment the pivoting hood assembly is positioned at an angle of about 45 degrees or greater when the tread base is at its greatest grade of incline. In one embodiment the pivoting hood assembly is positioned at an angle to greater than 55 degrees when the tread base is at its greatest grade of incline. In one embodiment the pivoting hood assembly is positioned at an angle to greater than 65 degrees when the tread base is at its greatest grade of incline. In one embodiment the pivoting hood assembly is positioned at an angle to greater than 75 degrees when the tread base is at its greatest grade of incline.

In one embodiment of the present invention, the pivot point of the pivoting hood assembly is positioned distally from the distal end of the tread base. The positioning of the pivot point distally from the distal end of the tread base can reduce twisting of the inclining tread base and torsion of an endless belt positioned on the inclining tread base. In another embodiment, the inclining tread base is not coupled to the frame of the treadmill but is coupled to the pivoting hood assembly. In another embodiment, the frame is positioned beneath less than 75 percent of the length of the tread base. For example, in one exemplary embodiment the frame is positioned beneath less than 20 percent of the length of the tread base.

In another embodiment, the inclining tread base is only coupled to the pivoting hood assembly of the treadmill. This allows the inclining tread base to move freely of encumbrances that could be posed by a frame, or other component of the treadmill. By allowing the inclining tread base to move freely of encumbrances that could be posed by components of the treadmill, the pivoting hood assembly can incline the tread base to a desired grade with less complication, utilizing a smaller amount of force, and at a greater degree of incline.

In yet another embodiment, the pivoting hood assembly includes a hood assembly pivot and a tread base pivot. The hood assembly pivot provides a pivotal coupling to the frame of the treadmill. The tread base pivot provides a pivotal coupling to the inclining tread base. By utilizing a hood assembly pivot and a tread base pivot, the pivoting hood assembly can utilize two pivot points which work in cooperation to achieve a greater degree of incline than may otherwise be possible. In one exemplary embodiment, the pivoting hood assembly is coupled to the frame at only the hood assembly pivot and is coupled to the inclining tread base at only the pivoting hood assembly.

In another embodiment, the inclining treadmill utilizes a pivoting hood assembly having a lift motor, a hood assembly pivot, a pivoting plate, a channel bracket assembly, and a tread base pivot. The lift motor is configured to provide the force required to pivot the pivoting hood assembly and cause inclining of the tread base. The hood assembly pivot is configured to pivotally couple the pivoting hood assembly to the frame. The pivoting plate is coupled to the hood assembly pivot. The channel bracket assembly is coupled to the pivoting plate. The lift motor engages the channel bracket assembly to pivot the pivoting hood assembly about the hood assembly pivot. As the hood assembly pivots about the hood assembly pivot, the tread base pivot allows inclining of the tread base. For example, in one embodiment the lift motor engages the channel bracket at a point distal to the hood assembly pivot. In another embodiment, the lift motor pulls against the channel bracket to increase the degree of inclining and pushes against channel bracket to decrease the degree of incline of the tread base.

These and other feature of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXEMPLARY EMBODIMENTS

Figure 1A:
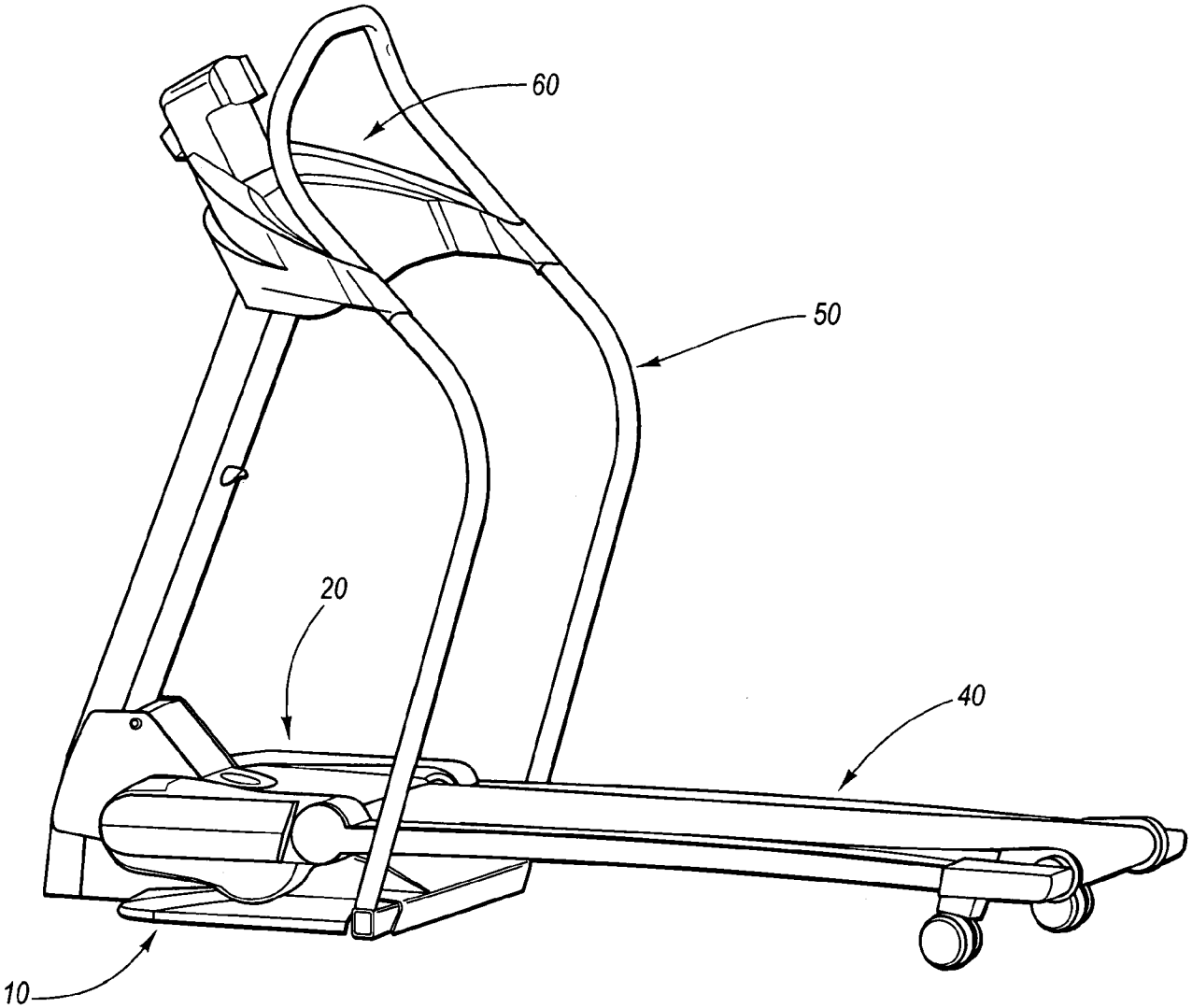
FIG. 1A is a perspective view of a treadmill in a horizontal position according to one exemplary embodiment of the present invention.

The present invention relates to an inclining treadmill having a hood assembly pivotally coupled between the frame and the inclining tread base of the treadmill. The pivoting hood assembly allows the inclining tread base to incline to a grade of at least 20 percent. In one embodiment, the inclining tread base can incline to a grade at least 35 percent. In another embodiment, the inclining tread base can incline to a grade of at least 45 percent. In another embodiment, the inclining tread base can incline to a grade of at least 50 percent.

The pivoting hood assembly is positioned at an angle to greater than about 40 degrees when the tread base is at its greatest grade of incline. In one embodiment the pivoting hood assembly is positioned at an angle of about 45 degrees or greater when the tread base is at its greatest grade of incline. In one embodiment the pivoting hood assembly is positioned at an angle to greater than 55 degrees when the tread base is at its greatest grade of incline. In one embodiment the pivoting hood assembly is positioned at an angle to greater than 65 degrees when the tread base is at its greatest grade of incline. In one embodiment the pivoting hood assembly is positioned at an angle to greater than 75 degrees when the tread base is at its greatest grade of incline.

In one embodiment, the pivot point of the pivoting hood assembly is positioned distally from the distal end of the tread base. The positioning of the pivot point distally from the distal end of the tread base can reduce twisting of the inclining tread base and reduce torsion of an endless belt positioned on the inclining tread base. In another embodiment, the inclining tread base is not coupled to the frame of the treadmill but is coupled to the pivoting hood assembly. In another embodiment, the frame is positioned beneath less than 75 percent of the length of the tread base. For example, in one exemplary embodiment the frame is positioned beneath less than 20 percent of the length of the tread base.

In another embodiment, the inclining tread base is only coupled to the pivoting hood assembly of the treadmill. This allows the inclining tread base to move freely of encumbrances that could be posed by a frame, or other component of the treadmill. By allowing the inclining tread base to move freely of encumbrances that could be posed by components of the treadmill, the pivoting hood assembly can incline the tread base to a desired grade with less complication, utilizing a smaller amount of force, and at a greater degree of incline. In yet another embodiment, the pivoting hood assembly includes a hood assembly pivot and a tread base pivot. The hood assembly pivot provides a pivotal coupling to the frame of the treadmill. The tread base pivot provides a pivotal coupling to the inclining tread base. By utilizing a hood assembly pivot and a tread base pivot, the pivoting hood assembly can utilize two pivot points which work in cooperation to achieve a greater degree of incline than may otherwise be possible. In one exemplary embodiment, the pivoting hood assembly is coupled to the frame at only the hood assembly pivot and is coupled to the inclining tread base at only the pivoting hood assembly.

In another embodiment, the inclining treadmill utilizes a pivoting hood assembly having a lift motor, a hood assembly pivot, a pivoting plate, a channel bracket assembly, and a tread base pivot. The lift motor is configured to provide the force required to pivot the pivoting hood assembly and cause inclining of the tread base. The hood assembly pivot is configured to pivotally couple the pivoting hood assembly to the frame. The pivoting plate is coupled to the hood assembly pivot. The channel bracket assembly is coupled to the pivoting plate. The lift motor engages the channel bracket assembly to pivot the pivoting hood assembly about the hood assembly pivot. As the hood assembly pivots about the hood assembly pivot, the tread base pivot allows inclining of the tread base. For example, in one embodiment the lift motor engages the channel bracket at a point distal to the hood assembly pivot. In another embodiment, the lift motor pulls against the channel bracket to increase the degree of inclining of the tread base and pushes against channel bracket to decrease the degree of incline of the tread base.

FIG. 1 is a perspective view of an inclining treadmill 1 according to one embodiment of the present invention. Inclining treadmill 1 includes a pivoting hood assembly 20 adapted to incline a tread base 40 to a grade of at least 20 percent. By utilizing a pivoting hood assembly that can incline a tread base to a grade of at least 20 percent, inclining treadmill 1 provides a user with an exercise experience with greater interest and additional exercise benefits. Additionally, the pivoting hood assembly comprises a mechanism for inclining the tread base 40 to a grade of at least 20 percent that also has a simple design and a greater degree of reliability in operation of the tread base 40.

Pivoting hood assembly 20 is positioned at an angle to greater than 40 degrees when tread base 40 is at its greatest grade of incline. In one embodiment pivoting hood assembly 20 is positioned at an angle to greater than 50 degrees when tread base 40 is at its greatest grade of incline. In one embodiment pivoting hood assembly 20 is positioned at an angle to greater than 60 degrees when tread base 40 is at its greatest grade of incline. In one embodiment pivoting hood assembly 20 is positioned at an angle to greater than 70 degrees when tread base 40 is at its greatest grade of incline. In one embodiment pivoting hood assembly 20 is positioned at an angle to greater than 75 degrees when tread base 40 is at its greatest grade of incline.

In the illustrated embodiment, inclining treadmill 1 includes a frame 10, a pivoting hood assembly 20, a tread base 40, a handrail assembly 50, and a wrap around console 60. Frame 10 provides stability and support to other components of inclining treadmill 1. Pivoting hood assembly is coupled to frame 10 and to tread base 40. Pivoting hood assembly is adapted to incline tread base 40 to a grade of at least 20 percent. Tread base 40 is coupled to pivoting hood assembly 20. Tread base 40 provides an exercise surface for inclining treadmill 1. Tread base 40 is adapted to incline to a grade of at least 20 percent. Handrail assembly 50 is coupled to frame 10. Handrail assembly 50 provides a mechanism allowing a user to stabilize himself or herself while performing an exercise routine on inclining treadmill 1. Wrap around console 60 is coupled to handrail assembly 50. Wrap around console 60 provides a user interface allowing a user to view exercise program information and make adjustments to inclining treadmill 1 during an exercise routine being performed.

In the illustrated embodiment, it can be seen that frame 10 is positioned primarily below pivoting hood assembly 20. In one embodiment, frame 10 is positioned beneath less than 75 percent of the length of the tread base. In the illustrated embodiment, frame 10 is positioned beneath less than 20 percent of the length of the tread base 40. By being positioned beneath less than 20 percent of the tread base 40, tread base 40 can be folded into a storage position having substantially smaller footplate than if frame 10 were positioned beneath a larger portion of tread base 40. In the illustrated embodiment, a roller wheel assembly 48 is coupled to the proximal portion of tread base 40. Roller wheel assembly 48 allows the proximal portion of tread base 40 to move in the direction of frame 10 as tread base 40 increases its grade of inclination.

Figure 1B:
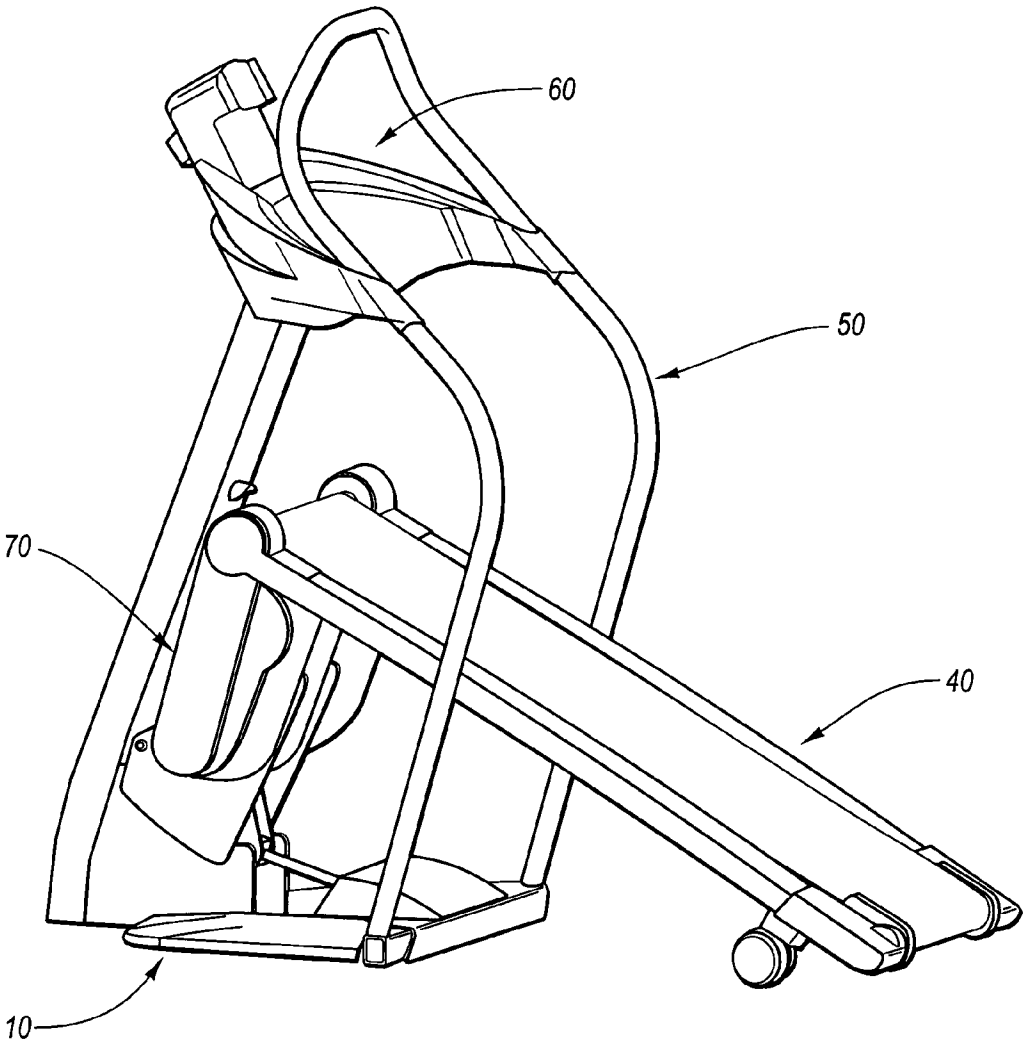
FIG. 1B is a perspective view of the treadmill of FIG. 1A in an inclined position according to one exemplary embodiment of the present invention.

FIG. 1B is a perspective view of inclining treadmill 1 illustrating tread base 40 in an inclined position. In the illustrated embodiment, tread base 40 is positioned at its greatest degree of incline. The greatest degree of incline of tread base 40 is approximately 50 percent. Pivoting hood assembly is positioned at an angle of greater than 50 percent when tread base is at its greatest degree of incline. For example, pivoting hood assembly 20 is positioned at a grade of approximately 80 percent when tread base 40 is at a degree at a grade of 50 percent.

When tread base 40 is in the inclined position, roller wheel assembly 48 is positioned closer to frame 10. Roller wheel assembly 48 allows for the smooth and unobstructed movement of the proximal end of tread base 40 as tread base 40 moves from a non-inclined position to an inclined position. Similarly, roller wheel assembly 48 allows the proximal end of pivoting hood assembly to move closer to frame 10 as the degree of incline increases. The configuration of handrail assembly 50 allows a user to grasp handrail assembly 50 during exercise when tread base 40 is positioned at varying degrees of inclination.

In the illustrated embodiment, pivoting hood assembly is pivotally coupled to frame 10. Tread base 40 is pivotally linked to frame 10 by being pivotally coupled to pivoting hood assembly 20. By being coupled only to pivoting hood assembly 20, tread base 40 can change its degree of incline without obstruction from other components of inclining treadmill 1.

Figure 2:
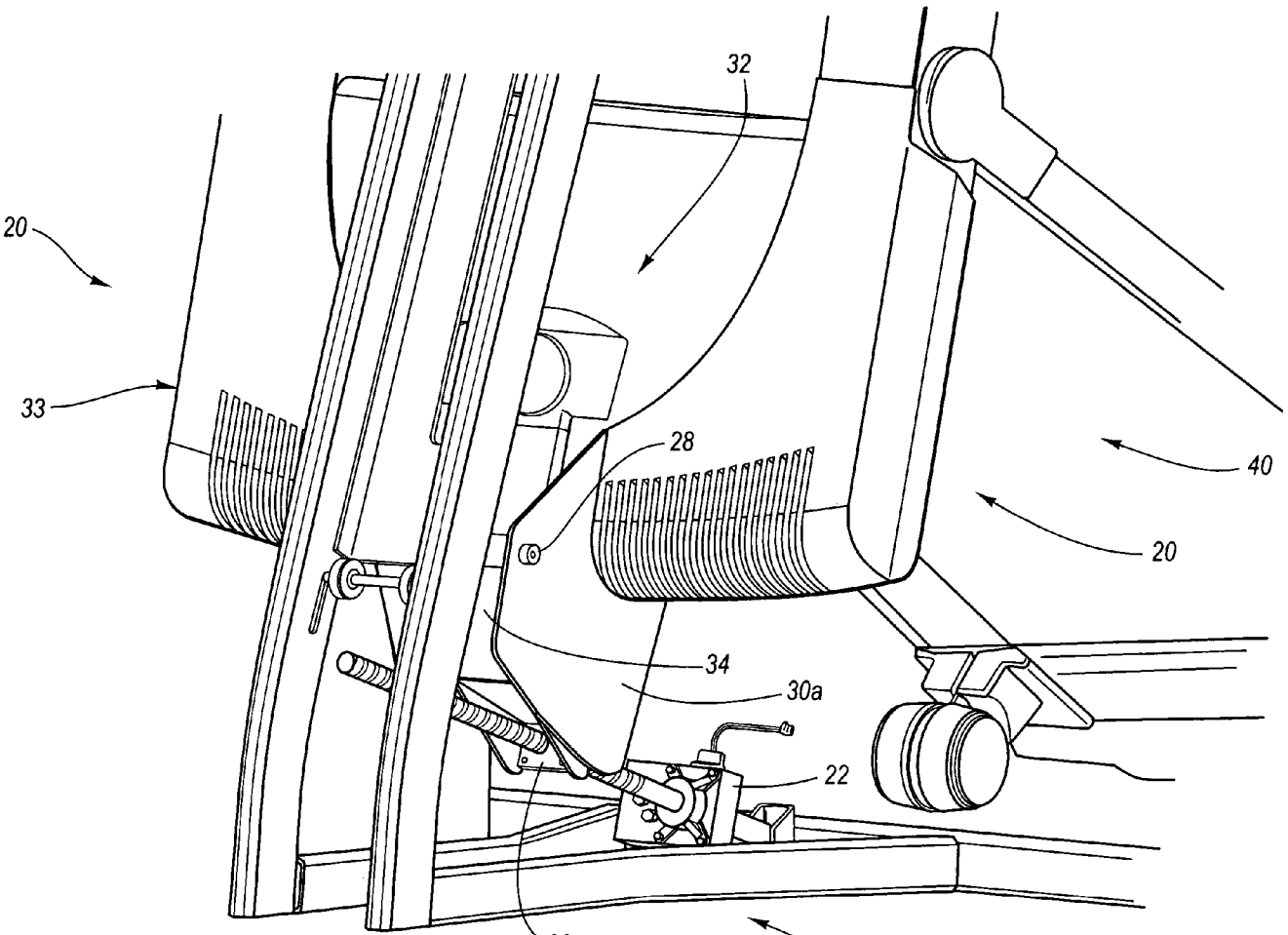
FIG. 2 is a front perspective view illustrating the pivoting hood assembly according to one exemplary embodiment of the present invention.

FIG. 2 is a front perspective view of inclining treadmill 1 illustrating several of the internal components of pivoting hood assembly 20. Some of the components of inclining treadmill 1 have been removed to more clearly depict the components of pivoting hood assembly 20. Pivoting hood assembly 20 is coupled between frame 10 and tread base 40. Pivoting hood assembly is adapted to incline tread base 40. Pivoting hood assembly 20 includes a lift motor 22, lead screw 24, a nut 26, a hood assembly pivot 28, pivoting plates 30*a, b* (pivoting plate 30*b* not shown), a channel bracket assembly 32, and a hood housing 33.

Lift motor 22 provides the lifting force required to cause pivoting of pivoting hood assembly 20 and inclining of tread base 40. In the illustrated embodiment, lift motor 22 comprises a lead screw lift motor providing a rotational force to lead screw 24. Lead screw 24 engages nut 26. Rotation of lead screw 24 and the interaction with nut 26 causes movement of nut 26 with respect to lift motor 22.

Nut 26 is rigidly coupled to an end of channel bracket assembly 32. Channel bracket assembly 32 is rigidly coupled to pivoting plates 30*a, b*. Pivoting plates 30*a, b* are pivotally coupled to frame 10 at hood assembly pivot 28. The coupling of nut 26, channel bracket assembly 32, pivoting plates 30*a, b,* and frame 10 at hood assembly pivot 28 is such that movement of nut 26 in the direction of lift motor 22 causes pivoting of pivoting hood assembly 20 about hood assembly pivot 28 and an increase in the inclination of tread base 40. Rotation of lead screw 24 in the opposite direction causes movement of nut 26 away from lift motor 22. Movement of nut 26 away from lift motor 22 causes pivoting of pivoting hood assembly 20 in the opposite direction and a decrease in the inclination of tread base 40.

Hood housing 33 is configured to cover channel bracket assembly 32 and other internal component of inclining treadmill positioned adjacent channel bracket assembly 32. Hood housing 33 provides protection to the internal components of inclining treadmill 1 while also preventing a user from inadvertently placing fingers, or other body parts in the moving components of inclining treadmill 1. In the illustrated embodiment, hood assembly pivot 28 is positioned distally from the distal end of the tread base. Hood assembly pivot 28 is one example of a pivot point provided by pivoting hood assembly 20.

Lift motor 22 engages channel bracket 32 utilizing lead screw 24 and nut 26 at a point distal to hood assembly pivot 28. Lift motor 22 pulls against nut 26 to increase the degree of incline of tread base 40 and pushes against nut 26 to decrease the degree of incline of tread base 40. The configuration of pivoting hood assembly 20 allows inclining of tread base 40 to a grade of at least 20 percent in a reliable and smooth manner. Pivoting hood assembly 20 is positioned at an angle of greater than 50 percent when tread base 40 is at its greatest degree of incline.

Figure 3:
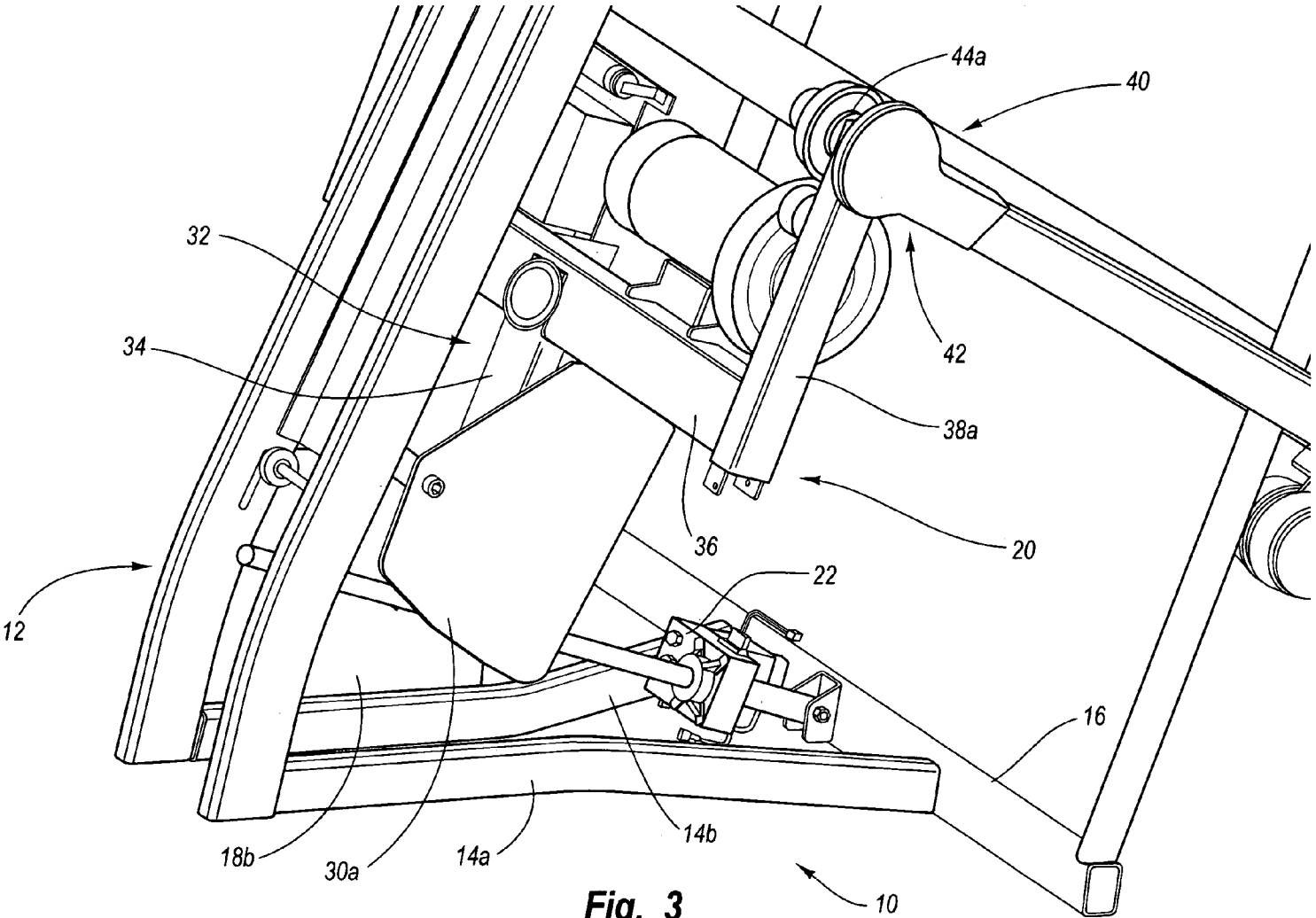
FIG. 3 is a side perspective view illustrating the components of the pivoting hood assembly according to one exemplary embodiment of the present invention.

FIG. 3 is a side perspective view of inclining treadmill 1 illustrating the internal components of pivoting hood assembly 20. Pivoting hood assembly 20 is coupled to frame 10. Frame 10 provides support to other components of inclining tread base 1. Pivoting hood assembly 20 includes a channel bracket assembly 32. In the illustrated embodiment, channel bracket assembly 32 includes a channel bracket 34, a cross member 36, and tread base support members 38*a, b.* Channel bracket 34 is the distal most portion of channel bracket assembly 32. Channel bracket 34 is connected to nut 26 (see FIG. 3) to receive the forces exerted by lift motor 22.

Cross member 36 is coupled to the proximal portion of channel bracket 34. Cross member 36 provides a point of coupling for pivoting plates 30*a, b.* This allows rigid side plates 18*a, b* to be interposed between channel bracket 34 and pivoting plates 30*a, b* while providing a mechanism for coupling pivoting plates 30*a, b* to channel bracket assembly 32. As will be appreciated by those skilled in the art, a variety of types and configurations of the position of the pivot plates relative to the rigid side plates can be utilized without departing from the scope and spirit of the present invention. For example, in one embodiment rigid side plates are positioned external to pivoting plates. In another embodiment, pivoting plates are coupled to channel bracket.

Tread base support members 38*a, b* are coupled to the ends of cross member 36. Tread base support members 38*a, b* are pivotally coupled to tread base 40 at tread base pivot 42. In the illustrated embodiment, tread base pivot 42 comprises first pivot mechanism 44*a* and a second pivot mechanism 44*b* (not shown). First pivot mechanism 44*a* is associated with tread base support member 38*a*. Second pivot mechanism 44*b* is associated with tread base support member 38*b*.

As will be appreciated by those skilled in the art, a variety of types and configurations of pivoting hood assemblies can be utilized without departing from the scope and spirit of the present invention. For example, a channel bracket assembly having a wider lateral configuration can be utilized. In another embodiment, the channel bracket assembly is directly connected to the hood assembly pivot instead of utilizing a pivot plate. In another embodiment, the lift motor is linked to a different portion of the pivoting hood assembly.

Figure 4:
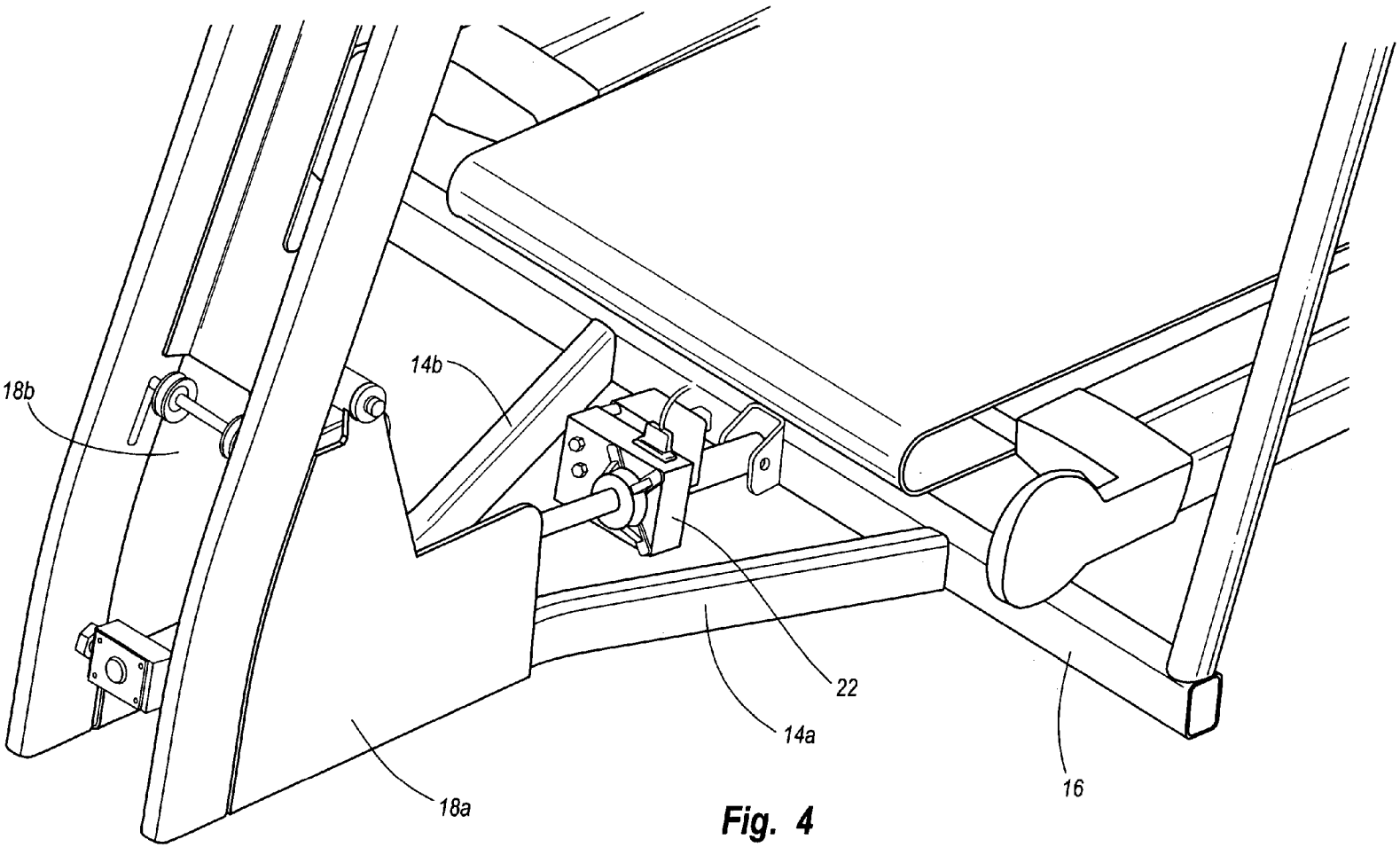
FIG. 4 is a side perspective view illustrating the frame of the treadmill according to one exemplary embodiment of the present invention.

FIG. 4 is a side perspective view of the frame of tread base 40 according to one aspect of the present invention. Frame 10 provides support to other components of inclining tread base 1. Frame 10 includes an upright frame member 12, base cross members 14*a, b,* lateral support 16, and rigid side plates 18*a, b.* Upright frame member 12 provides support to handrail assembly 50 and wrap around console 60. Upright frame member 12 is coupled to pivoting hood assembly 20 at hood assembly pivot 28.

Base cross members 14*a, b* are positioned between upright frame member 12 and lateral support 16. Base cross members 14*a, b* provide a desired amount of displacement between upright frame member 12 and lateral support 16. The amount of displacement between upright frame member 12 and lateral support 16 provides additional stability to inclining treadmill 1. Lateral support 16 is coupled to base cross members 14*a, b.* Lateral support 16 provides lateral stability to inclining treadmill 1 to minimize lateral movement of inclining treadmill 1 during exercise.

Rigid side plates 18*a, b* (rigid side plate 18*b* not shown) are coupled to upright frame member 12 and base cross members 14*a, b.* Rigid side plates 18*a, b* are positioned inside pivoting plates 30*a, b* (See FIG. 3). Rigid side plates 18*a, b* prevent a user or other individual from inadvertently placing fingers, other body members, other materials, or objects between upright frame member 12 and pivoting plates 30*a, b* during movement of pivoting plates 30*a, b.*

Figure 5A:
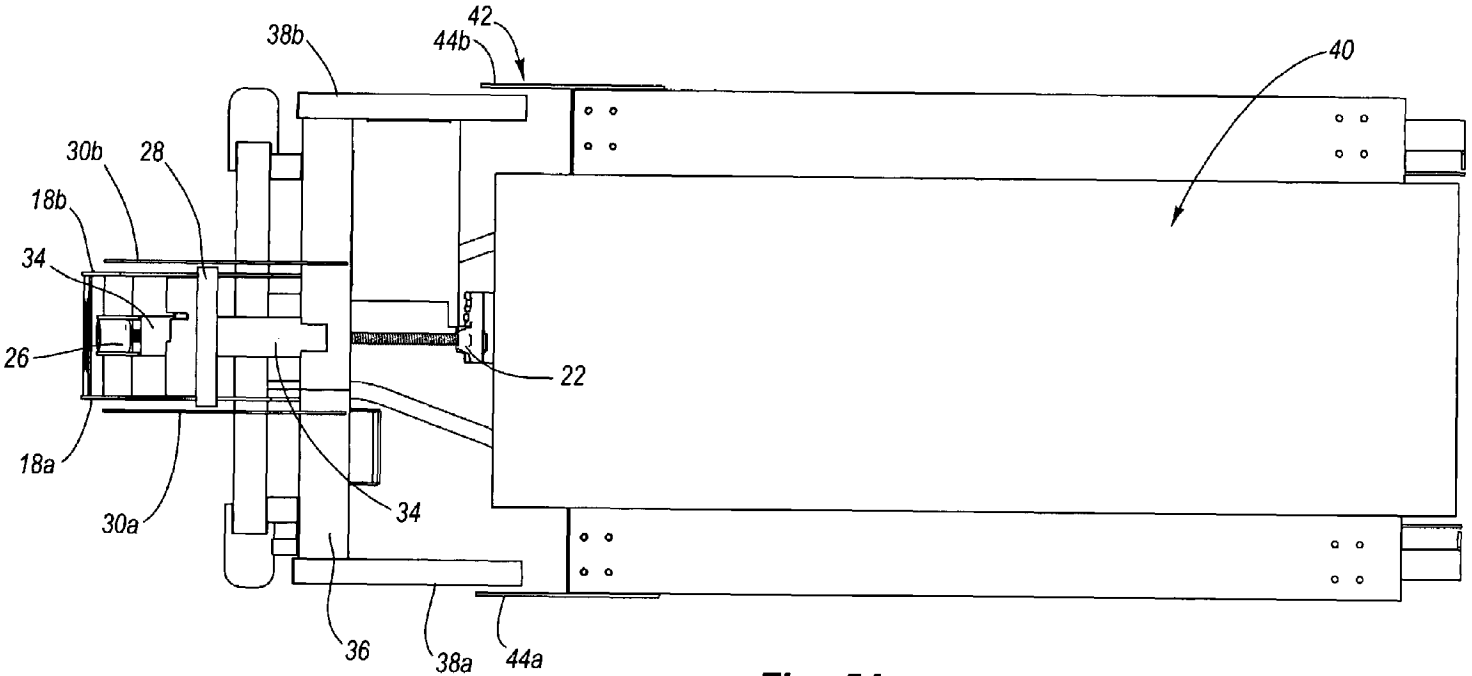
FIG. 5A is top view of the treadmill illustrating the components of the pivoting hood assembly according to one embodiment of the present invention.

FIG. 5A is a top view of inclining treadmill 1 illustrating the internal components of pivoting hood assembly 20. In the illustrated embodiment, rigid side plates 18*a, b* are positioned between pivoting plates 30*a, b* and channel bracket 34. As previously discussed, this configuration prevents a user from inserting their fingers or other materials or objects into the internal components of inclining treadmill during movement of pivoting hood assembly 20.

The juxtaposition of channel bracket 34, cross member 36, and tread base support members 38*a, b* relative to one another is also shown. Tread base support members 38*a, b* are positioned on the end of cross member 36. The proximal portion of tread base support members 38*a, b* are pivotally coupled to tread base 40 at tread base pivot 42. Tread base support member 38*a* is coupled to tread base 40 at first pivot mechanism 44*a*. Tread base support member 38*b* is coupled to tread base 40 at second pivot mechanism 44*b*.

Lift motor 22 causes rotational movement of lead screw 24. Lead screw 24 engages nut 26 such that rotational movement of lead screw 24 causes movement of the distal portion of channel bracket 34. The rigid coupling of channel bracket 34, cross member 36, and pivoting plates 30*a, b* cause pivoting of pivoting hood assembly 20 about hood assembly pivot 28. Movement of pivoting head assembly 20 about hood assembly pivot 28 results in pivoting of both hood assembly 20 and tread base 40 about tread base pivot 42. Pivoting about tread base pivot 42 causes inclining of tread base 40.

Figure 5B:
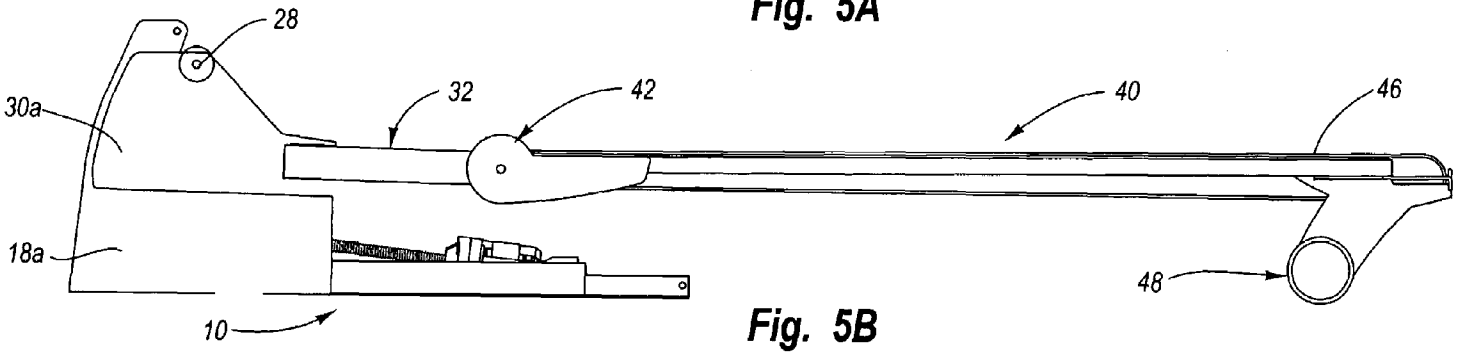
FIG. 5B is a side perspective view of the treadmill in a horizontal position illustrating the components of the pivoting hood assembly according to another embodiment of the present invention.

FIG. 5B illustrates a side view of inclining treadmill 1 illustrating the internal components of pivoting hood assembly 20. In the illustrated embodiment, inclining treadmill 1 is in a non-inclined position. In the non-inclined position, hood assembly 20 is positioned at approximately the same degree of incline as tread base 40. The bottom of pivoting plate 30*a* is approximately parallel to the bottom of rigid side plate 18*a*. In this position, the displacement between frame 10 and tread base pivot 42 is minimal.

Figure 5C:
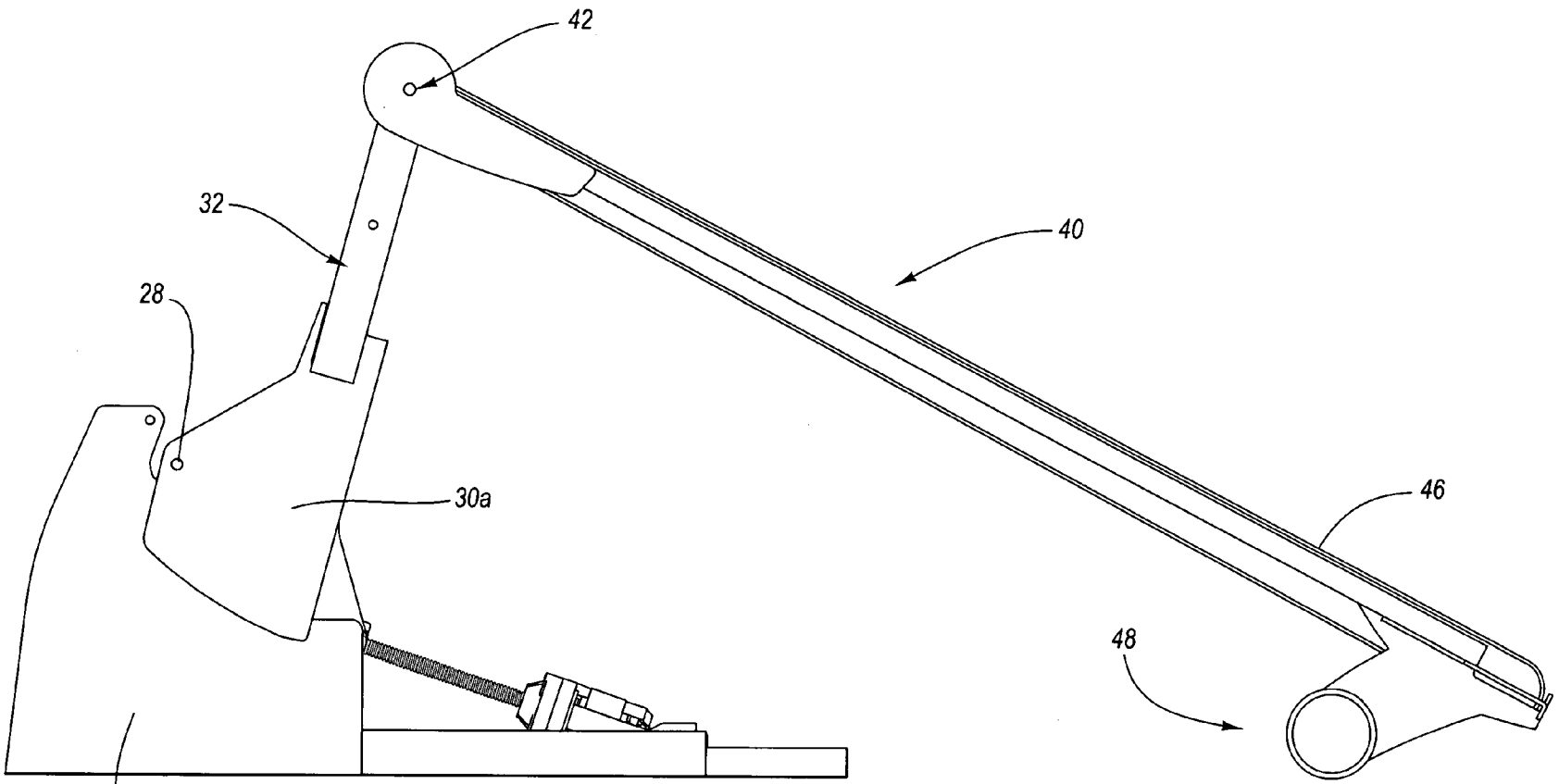
FIG. 5C is a side perspective view of the treadmill in an inclined position illustrating the components of the pivoting hood assembly according to another embodiment of the present invention.

FIG. 5C is a side perspective view of inclining treadmill 1 in an inclined position illustrating the internal components of pivoting hood assembly 20. In the illustrated embodiment, pivoting hood assembly 20 has been substantially rotated about hood assembly pivot 28 relative to FIG. 5B. The bottom of pivoting plate 30*a* has moved from an almost parallel position relative to the bottom of rigid side plate 18, to a nearly perpendicular position. Similarly, pivoting hood assembly 20 is positioned in an almost perpendicular position relative to tread base 40. Tread base pivot 42 is positioned at a greater displacement relative to frame 10. As will be appreciated by those skilled in the art, a variety of types and configurations of inclining treadmills can be utilized without departing from the scope and spirit of the present invention. For example, the lift motor can be coupled to the proximal portion of the pivoting hood assembly rather than the distal portion of the pivoting hood assembly. In another embodiment, the tread base pivot is positioned closer to the middle of the tread base rather than at the distal end of the tread base.

Figure 6:
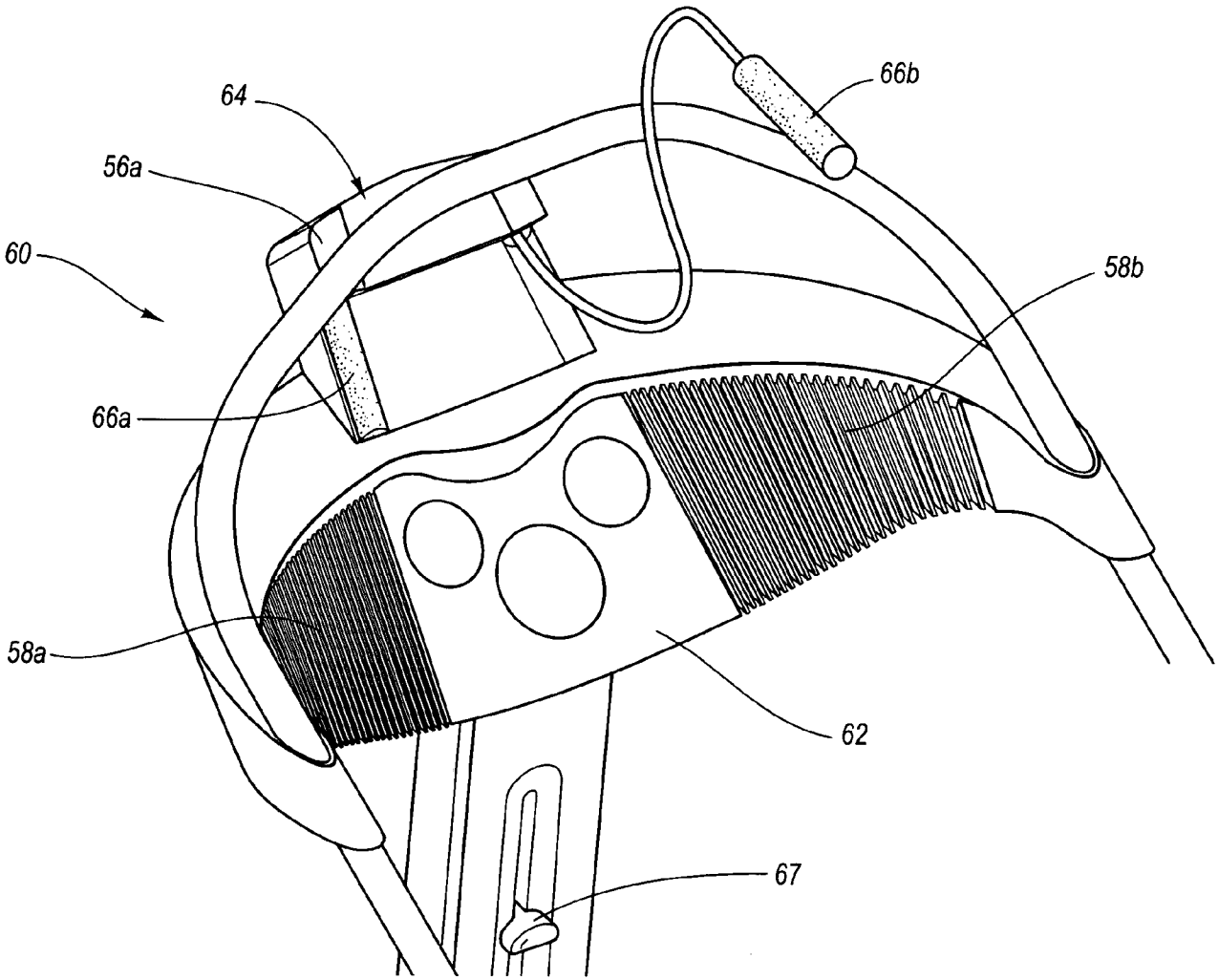
FIG. 6 is a perspective view of the wrap around console according to one embodiment of the present invention.

FIG. 6 illustrates wrap around console 60 of inclining treadmill 1 according to one embodiment of the present invention. In the illustrated embodiment, wrap around console 60 includes a user interface 62, an arm exercise apparatus 64, and wrap around lateral portions 68*a, b*. User interface 62 provides a mechanism for allowing a user to monitor parameters of the treadmill while also allowing a user to input commands or change program variables of the treadmill. Arm exercise apparatus 64 provides an arm resistance mechanism. Arm exercise apparatus 64 allows a user to exercise the user's arm during the treadmill workout routine. Wrap around lateral portions 68*a, b* are configured to be coupled to hand rail assembly 50. Due to the size and configuration of wrap around lateral portions 68*a, b, a* variety of different types of mechanisms and functionality can be provided by wrap around lateral portions 68*a, b*. For example, fans, or air conditioning units can be positioned wrap inside lateral portions 68*a, b* to cool a user during exercise.

In the illustrated embodiment, arm exercise apparatus 64 includes hand grips 66*a, b* and *a* resistance adjustment mechanism 67. Hand grips 66*a, b* can be decoupled from arm exercise apparatus 64 such that a user can grip hand grips 66*a, b*. Hand grips 66*a, b* are connected to resistance cables to provide resistance for the user during exercise. In one embodiment, the resistance cables comprise resilient members which provide resistance as the user stretches the adjustment cable. The user stretches the adjustment cable by pulling hand grip 66*a, b*.

Resistance adjustment mechanism 67 allows a user to adjust the amount of resistance utilized with respect to the arm exercise apparatus 64. Resistance adjustment mechanism 67 can be moved downwards or upwards to adjust the amount of resistance provided by arm exercise apparatus 64. In one embodiment where resilient cables are utilized, movement of adjustment mechanism 67 downward pretensions the cables such that the cables provide a greater amount of resistance for a given amount of displacement.

As will be appreciated by those skilled in the art, a variety of types and configurations of arm exercise apparatuses can be utilized without departing from the scope and spirit of the present invention. For example in one embodiment, the arm exercise apparatus is integrally positioned at the center of the wrap around console. In another embodiment, hand grips are positioned on the top and bottom portions of the arm exercise apparatus. In another embodiment, the arm exercise apparatus is provided in connection with a separate exercise apparatus such as a cable exercise machine.

In the illustrated embodiment, wrap around lateral portions 60*a, b* include a plurality of slits positioned therein. One or more fans positioned in wrap around lateral portion 68*a, b* force air through the slits so as to cool the user exercising on tread base 40. The curved configuration of wrap around lateral portions 68*a, b* direct the movement of forced air in a variety of directions to more effectively cool the user from a greater variety of angles. As will be appreciated by those skilled in the art, a variety of types and configurations of wrap around consoles can be utilized without departing from the scope and spirit of the present invention. For example, in one embodiment, the wrap around console does not include internal fans or other cooling mechanisms.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable inclining treadmill comprising:

a frame;

a pivoting hood assembly coupled to the flame, the pivoting hood assembly having a proximal end, a distal end, and a hood assembly pivot positioned therebetween;

an inclining tread base pivotally coupled to a proximal end of the pivoting hood assembly; and a lift motor adapted to engage the distal end of the pivoting hood assembly to pivot the pivoting hood assembly and cause inclination of the inclining tread base.

2. The adjustable inclining treadmill or claim 1, wherein the pivoting hood assembly is adapted to incline the tread base to at an angle of at least 30 degrees.

3. The adjustable inclining treadmill of claim 1, wherein the pivoting hood assembly is adapted to incline the tread base to a grade of at least 40 percent.

4. The adjustable inclining treadmill of claim 1, wherein the pivoting hood assembly is adapted to incline the tread base to a grade of at least 50 percent.

5. The adjustable inclining treadmill of claim 1, wherein the pivoting hood assembly is positioned at an angle to greater than 40 degrees when the tread base is at its greatest grade of incline.

6. The adjustable inclining treadmill of claim 1, wherein pivoting of the pivoting hood assembly causes inclining or the inclining tread base.

7. The adjustable inclining treadmill of claim 1, wherein the pivoting hood assembly includes a channel bracket assembly.

8. The adjustable inclining treadmill of claim 7, wherein the pivoting hood assembly is pivotally coupled to the frame at a hood assembly pivot.

9. The adjustable inclining treadmill of claim 8, wherein the lift motor engages the channel bracket assembly at a point distal to the hood assembly pivot.

10. An adjustable inclining treadmill comprising:

a frame;

a pivoting hood assembly coupled to the frame at a hood assembly pivot, the pivoting hood assembly comprising a channel bracket assembly, the channel bracket assembly having a distal end, the distal end being distal to the hood assembly pivot;

an inclining tread base pivotally coupled to one end of the pivoting hood assembly; and a lift motor adapted to engage the pivoting hood assembly such that retraction of the distal end of the channel bracket assembly increases the degree of incline of the tread base and extension of the distal end of the channel bracket assembly decreases lime degree of incline of the tread base.

11. The adjustable inclining treadmill of claim 10, wherein the pivoting hood assembly is positioned at an angle of about 45 degrees or greater when the tread base is at its greatest degree of incline.

12. The adjustable inclining treadmill of claim 10, wherein the pivoting hood assembly is positioned at an angle greater than 55 degrees when the tread base is at its greatest degree of incline.

13. The adjustable inclining treadmill of claim 10, wherein the pivoting hood assembly is positioned at an angle greater than 65 degrees when the tread base is at its greatest degree of incline.

14. The adjustable inclining treadmill of claim 10, wherein the pivoting hood assembly is positioned at an angle greater than 75 degrees when the tread base is at its greatest degree of incline.

15. The adjustable inclining treadmill of claim 10, wherein the pivoting hood assembly is pivotally coupled to an upright member of the frame.

16. The adjustable inclining treadmill of claim 10, wherein the pivoting hood assembly is coupled to an upright member of the frame only at the hood assembly pivot and is coupled to the inclining tread base only at a tread base pivot.

17. The adjustable inclining treadmill of claim 10, wherein pivoting of the pivoting hood assembly results in pivoting of the inclining tread base.

18. An adjustable inclining treadmill comprising:

a frame;

a pivoting hood asscmbly coupled to the frame, the pivoting hood assembly having a proximal end, a distal end, and a hood assembly pivot positioned therebetween, the pivoting assembly further comprising a channel bracket assembly, the channel bracket assembly having a distal end, the distal end of the channel bracket assembly being distal to the pivoting hood assembly;

an inclining tread base pivotally coupled to a proximal end of the pivoting hood assmbly; and a lift motor adapted to engage the distal end of the channel bracket assembly to pivot the pivoting hood assembly and cause inclination of the inclining tread base such that rotation of the lift motor in a first direction increases the degree of incline of the tread base and rotation of the lift motor in a second direction decreases the degree of incline of the tread base.

19. The inclining treadmill of claim 18, wherein the lift motor pulls against the channel bracket assembly to increase the degree of inclination of the tread base.

20. The inclining treadmill of claim 18, wherein the lift motor pushes against the channel bracket assembly to decrease the degree of inclination of the tread base.

21. The inclining treadmill of claim 18, wherein the lift motor comprises a lead screw lift motor.

22. The inclining treadmill of claim 21, wherein a lead screw of the lift motor engages a channel bracket of the channel bracket assembly.

23. An adjustable inclining treadmill comprising;

a frame;

an inclining tread base linked to the frame; and a pivoting hook assembly comprising;

a lift motor;

a hood housing configured to cover one or more internal component of the inclining treadmill;

a bracket assembly pivotally linked to the frame at a hood assembly pivot, the hood assembly pivot being offset from the distal end of the hood housing, wherein the lift motor engages the bracket assembly to pivot the pivoting hood assembly such that pivoting of the pivoting hood assembly causes inclination of the inclining tread base.

24. The adjustable inclining treadmill of claim 23, wherein the pivoting hood assembly is coupled to an upright member of the frame only at the hood assembly pivot and is coupled to the inclining tread base only at a tread base pivot.

25. The adjustable inclining treadmill of claim 23, wherein the frame includes an upright member.

26. The adjustable inclining treadmill of claim 25, wherein the pivoting hood assembly is coupled to the upright member of the frame.

* * * * *

UNITED STATES PATENT AND TRADEMARK OFFICE

CERTIFICATE OF CORRECTION

PATENT NO. : 7,285,075 B2
APPLICATION NO. : 10/733684
DATED : October 23, 2007
INVENTOR(S) : Gordon Cutler et al.

It is certified that error appears in the above-identified patent and that said Letters Patent is hereby corrected as shown below:

The title page should be deleted and substitute therefor the attached title page as shown on the attached page.

Column 1
Line 26, change "user a with" to --user with--

Column 2
Line 30, change "grade at least" to --grade of at least--
Line 41, change "angle to greater" to --angle of greater--
Lines 43-44, change "angle to greater" to --angle of greater--
Line 45, change "angle to greater" to --angle of greater--

Column 3
Line 35, change "feature" to --features--

Column 4
Line 23, change "grade at least" to --grade of at least--
Lines 28-29, change "angle to greater" to --angle of greater--
Line 34, change "angle to greater" to --angle of greater--
Lines 36-37, change "angle to greater" to --angle of greater--
Line 39, change "angle to greater" to --angle of greater--

Column 5
Line 26, change "FIG. 1" to --FIG. 1A--
Lines 39-40, change "angle to greater" to --angle of greater--
Line 42, change "angle to greater" to --angle of greater--
Line 45, change "angle to greater" to --angle of greater--
Line 47, change "angle to greater" to --angle of greater--
Line 50, change "angle to greater" to --angle of greater--

Column 8
Line 13, change "inclining tread base 1" to --including treadmill 1--

Column 9
Line 28, change "68a, b" to --58a, b--
Line 31, change "68a, b" to --58a, b--
Line 40, change "68a, b" to --58a, b--
Line 42, change "68a, b" to --58a, b--
Line 44, change "68a, b" to --58a, b--

UNITED STATES PATENT AND TRADEMARK OFFICE

CERTIFICATE OF CORRECTION

PATENT NO. : 7,285,075 B2
APPLICATION NO. : 10/733684
DATED : October 23, 2007
INVENTOR(S) : Gordon Cutler et al.

It is certified that error appears in the above-identified patent and that said Letters Patent is hereby corrected as shown below:

Line 44, change "units can be positioned wrap inside lateral portions" to --units can be positioned inside wrap around lateral portions--

Column 10
Line 9, change "60a, b" to --58a, b--
Line 11, change "68a, b" to --58a, b--
Line 13, change "68a, b" to --58a, b--
Line 33, change "flame" to --frame--
Line 53, change "angle to greater" to --angle of greater--
Line 57, change "causes inclining or the inclining tread base" to --causes inclining of the inclining tread base--

Column 11
Line 14, change "lime" to --the--

Column 12
Line 27, change "hook" to --hood--

Signed and Sealed this

Twenty-second Day of July, 2008

JON W. DUDAS
*Director of the United States Patent and Trademark Office*

(12) United States Patent
Cutler et al.

(10) Patent No.: US 7,285,075 B2
(45) Date of Patent: Oct. 23, 2007

(54) INCLINE TRAINER

(75) Inventors: Gordon Cutler, Providence, UT (US); Matthew R. Plott, River Heights, UT (US); William T. Dalebout, North Logan, UT (US)

(73) Assignee: Icon IP, Inc., Logan, UT (US)

( * ) Notice: Subject to any disclaimer, the term of this patent is extended or adjusted under 35 U.S.C. 154(b) by 152 days.

(21) Appl. No.: 10/733,684

(22) Filed: Dec. 11, 2003

(65) Prior Publication Data

US 2005/0130807 A1 Jun. 16, 2005

(51) Int. Cl.
*A63B 21/00* (2006.01)

(52) U.S. Cl. ..... 482/54

(58) Field of Classification Search ..... 482/54
See application file for complete search history.

(56) References Cited

U.S. PATENT DOCUMENTS

| | | | | |
|---|---|---|---|---|
| 4,759,540 | A * | 7/1988 | Yu et al. | 482/54 |
| 4,913,396 | A | 4/1990 | Dalebout et al. | 248/649 |
| 5,029,801 | A | 7/1991 | Dalebout et al. | 248/649 |
| 5,085,426 | A | 2/1992 | Wanzer et al. | 272/69 |
| 5,163,885 | A | 11/1992 | Wanzer et al. | 482/54 |
| 5,352,167 | A | 10/1994 | Ulicny | 482/54 |
| 5,372,559 | A | 12/1994 | Dalebout et al. | 482/54 |
| 5,683,332 | A | 11/1997 | Watterson et al. | 482/54 |
| 5,718,657 | A | 2/1998 | Dalebout et al. | 482/54 |
| 5,860,893 | A | 1/1999 | Watterson et al. | 482/54 |
| D421,779 | S | 3/2000 | Piaget et al. | D21/669 |
| 6,050,923 | A | 4/2000 | Yu | 482/54 |
| 6,132,340 | A | 10/2000 | Wang et al. | 482/54 |
| 6,261,209 | B1 | 7/2001 | Coody | 482/54 |
| 6,273,843 | B1 | 8/2001 | Lo | 482/54 |
| D447,780 | S | 9/2001 | Arnold et al. | D21/669 |
| D450,792 | S | 11/2001 | Kuo | D21/669 |
| 6,432,026 | B1 | 8/2002 | Wang et al. | 482/54 |
| 6,461,275 | B1 | 10/2002 | Wang et al. | 482/8 |
| 6,475,121 | B2 | 11/2002 | Wang et al. | 482/54 |
| 6,533,707 | B2 | 3/2003 | Wang et al. | 482/54 |
| 6,913,563 | B2 * | 7/2005 | Chen | 482/54 |

FOREIGN PATENT DOCUMENTS

DE WO 03/101543 A1 12/2003

OTHER PUBLICATIONS

Reebok User's Manual—ACD1 Treadmill, Copyright 1998 (26 pages).

(Continued)

*Primary Examiner*—Stephen R. Crow

(57) ABSTRACT

The present invention relates to an inclining treadmill having a hood assembly pivotally coupled between the frame and the inclining tread base of the treadmill. The configuration of the pivoting hood assembly allows the inclining tread base to incline to a grade of at least 20 percent. The pivot point of the pivoting hood assembly is positioned distally from the distal end of the tread base. The pivoting hood assembly is positioned at an angle to greater than 40 degrees when the tread base is at its greatest grade of incline. A lift motor engages a channel bracket assembly of the pivoting hood assembly at a point distal to the pivot point of the pivoting hood assembly. The inclining tread base is linked to the frame of the treadmill by being coupled to the pivoting hood assembly.

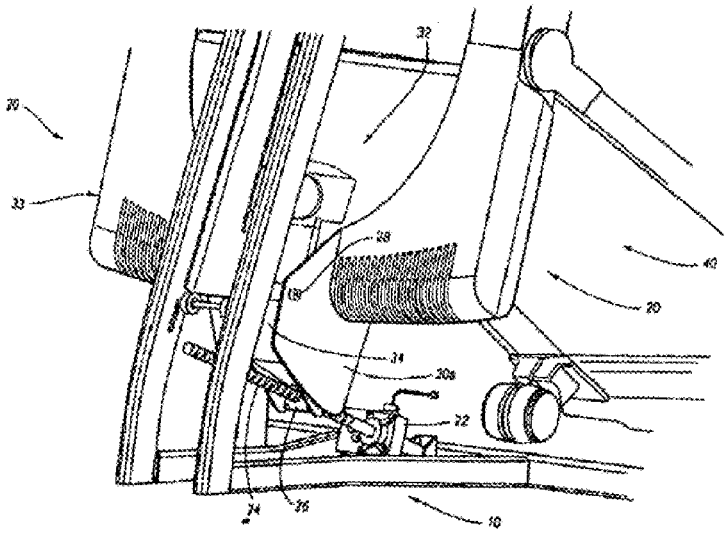

26 Claims, 8 Drawing Sheets